US005836486A

United States Patent [19]

Ohsugi

[11] Patent Number: 5,836,486

[45] Date of Patent: Nov. 17, 1998

[54] HANGER BAR

[75] Inventor: Yasuhiro Ohsugi, Hiroshima, Japan

[73] Assignee: NKG Co., Ltd., Hiroshima, Japan

[21] Appl. No.: 794,428

[22] Filed: Feb. 5, 1997

[30] Foreign Application Priority Data

Feb. 15, 1996 [JP] Japan ..... 8-028101
Nov. 6, 1996 [JP] Japan ..... 8-294249

[51] Int. Cl.[6] ..... A47G 25/02

[52] U.S. Cl. ..... 223/85; 223/DIG. 4; 211/113; 248/340

[58] Field of Search ..... 223/88, 85, DIG. 4, 223/DIG. 2, 1; 211/113; 248/340

[56] References Cited

U.S. PATENT DOCUMENTS

| | | | |
|---|---|---|---|
| 381,888 | 4/1988 | Rice | 223/88 |
| 1,914,840 | 6/1933 | Wolff | 223/88 |
| 2,058,217 | 10/1936 | Dixon | 223/85 |
| 2,127,870 | 8/1938 | Kennedy | 223/88 |
| 3,194,457 | 7/1965 | Freilich | 223/88 |
| 3,993,205 | 11/1976 | Pilchard | 223/88 |
| 4,872,568 | 10/1989 | Lehmann . | |
| 4,984,721 | 1/1991 | Eiley et al. | 223/96 |
| 5,303,855 | 4/1994 | Veale | 223/85 |
| 5,398,854 | 3/1995 | Blanchard | 223/96 |

FOREIGN PATENT DOCUMENTS

| | | | |
|---|---|---|---|
| 2 129 680 | 5/1984 | United Kingdom . | |
| 2 248 539 | 4/1992 | United Kingdom . | |
| 2273041 | 6/1994 | United Kingdom | 223/88 |

*Primary Examiner*—Bibhu Mohanty
*Attorney, Agent, or Firm*—Darby & Darby

[57] ABSTRACT

A plurality of recesses are aligned on a hanging member, and hangers are caught on engaging portions formed at the bottoms of the respective recesses. Thus, garments hung on the hangers can be suspended on the hanger bar of this invention at predetermined intervals therebetween.

6 Claims, 23 Drawing Sheets

HANGER BAR

BACKGROUND OF THE INVENTION

1. Field of the Invention

The present invention relates to a hanger bar for suspending hangers for hanging objects for drying, displaying and storing.

2. Description of Related Art

When a washed garment is to be dried, the garment is hung on a hanger and the hanger is suspended on a clothes-drying bar or the like. When plural hangers are suspended on a clothes-drying bar, a number of garments can be dried at one time within a given area.

However, when the hangers are suspended in the open air, the hangers can be moved by a wind during drying, so that the hangers are gathered in a part of the clothes-drying bar near one end thereof. In such a case, airing for the garments becomes poor, so that efficiency in drying them can be degraded. Moreover, since plural garments come too close to one another, the shape of a collar of, for example, a sport shirt can be spoiled. Furthermore, when only a short neck part of the hanger is projected from the neck of a garment hung on the hanger, the collar of the garment butt against the clothes-drying bar, resulting is also spoiling the shape of the collar. In addition, the hung garment can be swung by the wind, and the collar can be rubbed against the clothes-drying bar, resulting in spoiling the shape of the collar again.

BRIEF SUMMARY OF THE INVENTION

The present invention was devised to overcome the aforementioned problems, and the object is providing a hanger bar comprising a wavy shaped hanging member having a plurality of recesses aligned at intervals as engaging portions for hangers, so that objects to be hung can be suspended at predetermined intervals.

The hanger bar of this invention comprises a hanging member provided with a plurality of first recesses for catching hangers, the first recesses being aligned with openings facing toward one direction; and suspending members, for supporting the hanging member, set on both ends of the hanging member in an aligning direction of the first recesess.

Accordingly, when hangers are hung on the aligned recesses, each hanger is engaged with the bottom of each recess. As a result, even when a force in the aligning direction of the recesses is applied to the hanger, the hanger is prevented from moving to the adjacent recess beyond the edge of the opening of the engaged recess.

In one aspect of the hanger bar, each connecting portion between the adjacent first recesses is provided with a second recess having an opening facing in a direction reverse to the direction faced by the opening of the first recess.

Accordingly, the opening edge of the second recess is positioned in the vicinity of the bottom of the recess engaged with a hanger, and hence, for example, a collar of the garment hung on the hanger can be settled within the second recess. Thus, the shape of the collar is prevented from being rubbed against the hanging member and being spoiled.

In still another aspect, each of the first recesses has, on a bottom thereof, an engaging portion projecting in the direction faced by the opening of the first recess.

Accordingly, owing to the projected engaging portion, the hook-shaped portion of the suspending part of a hanger can lie along the projected shape, resulting in stabilizing the engagement between the hanger and the engaging portion.

In still another aspect, each of the suspending members is linked with the hanging member rotatably with the end of the hanging member as a center on a plane on which the first and second recesses are aligned.

Accordingly, by rotating the suspending members, the suspending members are used to suspend the hanging member when the hanger bar is used, and the suspending members are held to lie in the aligning direction of the recesses of the hanging member suitably for storage when a hanger bar is stored.

In still another aspect, the hanger bar further comprises a hanger including a shoulder part for hanging an object and at least one side part extended from an end of the shoulder part, a third recess fittable with the engaging portion being formed at substantially a center of the shoulder part, and the engaging portion is adoptable to be caught and support the third recess and the side part.

Accordingly, when the side part catches the engaging portion of the hanging member so as to support the hanger in the longitudinal direction, the hanger can be easily inserted through a narrow portion of an object, i.e., a garment. After inserting the hanger into the garment, the recess formed at substantially the center of the shoulder part is engaged with the engaging portion of the hanging member, so that the hanger is supported in the lateral direction. Then, the garment is hung on the shoulder part of the hanger.

In still another aspect, each of the suspending members includes a clipping part in a U-shape in a side view; and an elastic member for applying a force in a direction to make end of the clipping part closer to each other.

Accordingly, by clipping a bar such as a clothes-drying bar with the U-shaped clipping parts, the hanger bar is suspended on the bar. Since the elasticity of the elastic member applies a force to make the ends of the clipping part closer to each other, the hanger can be fixed on the bar against a wind or a sudden external force.

In still another aspect, the elastic member is a split ring spring, the clipping part is provided with spring bearing pieces projected outward from an outer face of the U-shape, and the split ring spring is supported and fixed by the spring bearing pieces at both ends with a center of the split ring spring positioned on a bottom of the U-shape of the clipping part.

Accordingly, owing to the elastic force of the split ring spring fixed on the clipping part, the ends of the clipping part are further strongly pushed to be closer to each other, resulting in enforcing the fixation on the bar. In addition, the elastic force of the split ring spring has a sufficient restoring force against long time usage, and hence, a bar with a small diameter can be firmly clipped even after clipping a bar with a large diameter for a long period of time.

In still another aspect, each of the suspending members includes clipping pieces opposing each other and linked with each other at one end thereof through a bent portion, each of the clipping pieces rounding out at substantially a center thereof, the other end of each of the clipping pieces being curved outward, and the clipping pieces are provided, at portions closer to the bent portion, with spring bearing pieces projected outward from outer faces of the clipping pieces, for supporting ends of a split ring spring for applying a force in a direction to make the clipping pieces closer to each other.

Accordingly, since the clipping pieces round out at their center, a bar such as a clothes-drying bar can be stably clipped. Moreover, since the tips of the clipping pieces are curved outward, the bar can be easily guided to the center of the clipping part in hanging the suspending member on the bar. Furthermore, owing to the elasticity of the split ring spring fixed on the curved portion of the clipping part, the ends of the clipping pieces are further strongly pushed to be closer to each other, resulting in enforcing the fixation on the bar.

In still another aspect, each of the spring bearing pieces includes a stop portion having a face formed toward the bent portion of the suspending member for stopping movement of the split ring spring in a lengthwise direction of the clipping pieces at the tips of the split ring spring; and first and second restricting portions each having a face formed along the lengthwise direction of the clipping pieces for restricting movement of the split ring spring in a widthwise direction of the clipping pieces at both sides of the ends of the split ring spring, and the split ring spring in supportable to be positioned along the bent portion with the ends thereof inserted into the spring bearing pieces.

Accordingly, since the tips of the split ring spring butt against the stop portions, the split ring spring is prevented from moving toward the ends of the clipping pieces. Also, since the both sides of the ends of the split ring spring butt against the first and second restricting portions, the split ring spring is prevented from shifting in the widthwise direction of the clipping pieces. Furthermore, since the first and second restricting portions are disposed on the different positions in the lengthwise direction of the clipping pieces, the split ring spring can be easily inserted into the spring bearing pieces. In this manner, the split ring spring is fixed by the stop portion and the first and second restricting portions of the spring bearing pieces, resulting in preventing from shifting in the widthwise direction and coming off from the spring bearing pieces.

The above and further objects and features of the invention will more fully be apparent from the following detailed description with accompanying drawings.

DETAILED DESCRIPTION OF THE INVENTION

The present invention will now be described with reference to the accompanying drawings illustrating embodiments thereof.

Figure 1:
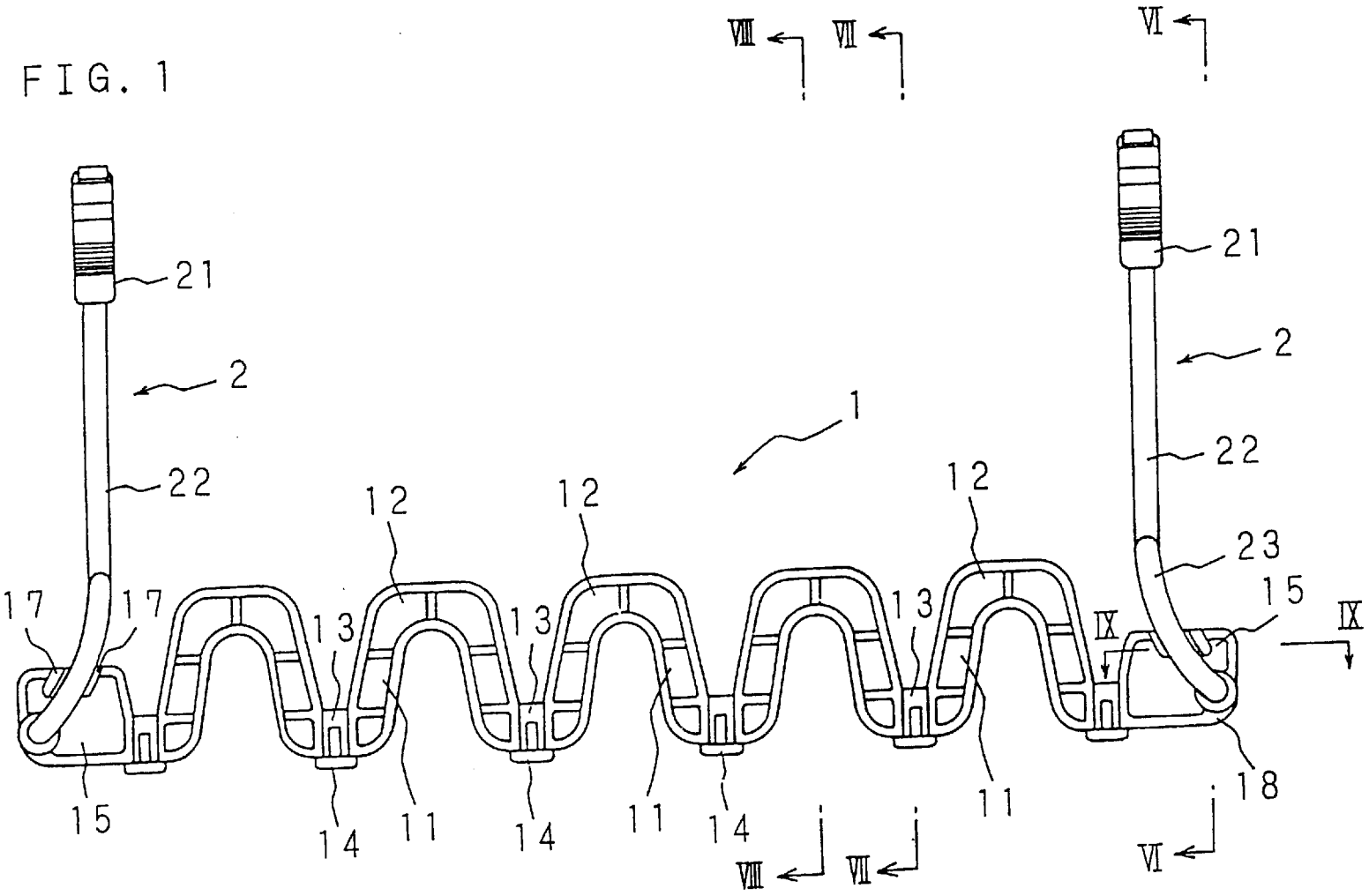
FIG. 1 is a front view for showing the structure of a hanger bar according to this invention.

FIG. 1 is a front view for showing the structure of a hanger bar according to the invention, and FIGS. 2 through 5 are respectively a right side view, a rear side view, a plan view and a bottom view thereof. Also, FIGS. 6, 7, 8 and 9 are sectional views taken on lines VI—VI, VII—VII, VIII—VIII and IX—IX of FIG. 1, respectively. As is shown in these drawings, the hanger bar comprises a hanging member 1 having a wavy form extending in the lateral direction in a front view, and suspending members 2 provided at both ends of the hanging member 1. The hanger bar is suspended on a clothes-drying bar or the like with the suspending members 2, and hangers are hung on recesses 11 formed at intervals on the hanging member 1.

The hanging member 1 is made of a synthetic resin such as polypropylene, has a predetermined thickness in the back-and-forth direction, and is integrally formed so as to have the following elements: A plurality of first recesses 11, each having a recessed peripheral face with its opening facing upward, are aligned in the lateral direction. Each connecting portion between the adjacent recesses 11 is provided with a second recess 12 having a laterally recessed peripheral face with its opening facing downward. Linking parts 15 are provided at both ends of the hanging member 1 to be linked with the suspending members 2. At the bottom of each recess 11, an engaging projection 13 is formed to be projected upward and have a peripheral face extending in the back-and-forth direction. The lateral edges of the engaging projection 13 butt against and are continuous with the inner peripheral faces of the respective adjacent recesses 11. At the lower end of the peripheral face of the engaging projection 13, rotation supporting pieces 14 are projected forward and backward, respectively. The recesses 11 and 12 are formed at regular intervals, and the interval is determined so that sufficient airing can be attained when hangers respectively hanging garments are caught on the recesses 11 and that the collar of each hung garment can be settled within the opening of each recess 12, and is specifically approximately 7 cm. Also, each engaging projection 13 has a lateral dimension sufficient for stably catching a hanger, and the lateral dimension is specifically approximately 9 through 10 mm.

Each of the linking parts 15 disposed at each end of the hanging member 1 has substantially a rectangular parallelepiped shape having the same thickness as the recesses 11 and 12. At the lower ends in the lateral direction on the front and rear faces of the linking part 15, engaging holes 16 to be engaged with the suspending member 2 are formed each in a predetermined depth in the back-and-forth direction. Furthermore, at the upper centers on the front and rear faces of the linking part 15, a first latching click pair 17 for locking the suspending member 2 at positions for suspending on a bar are projected with a predetermined distance. A second latching click 18 for locking the suspending member 2 at positions for folding is projected directly below the engaging holes 16.

Figure 2:
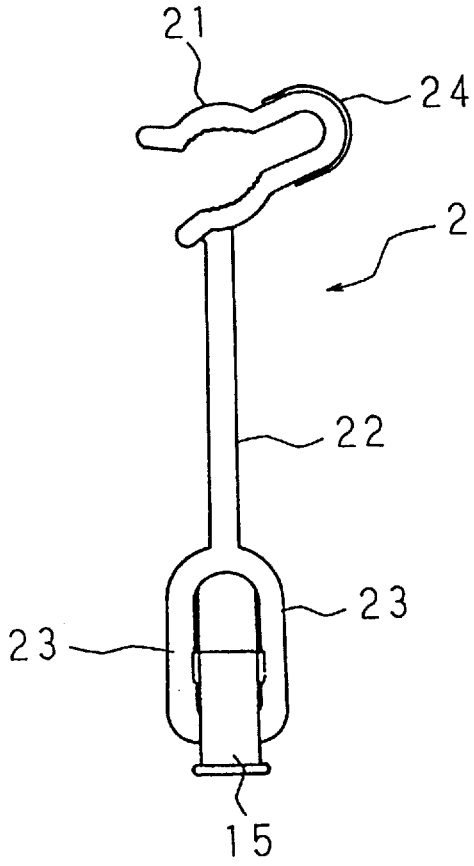
FIG. 2 is a right side view for showing the structure of the hanger bar.
Figure 3:
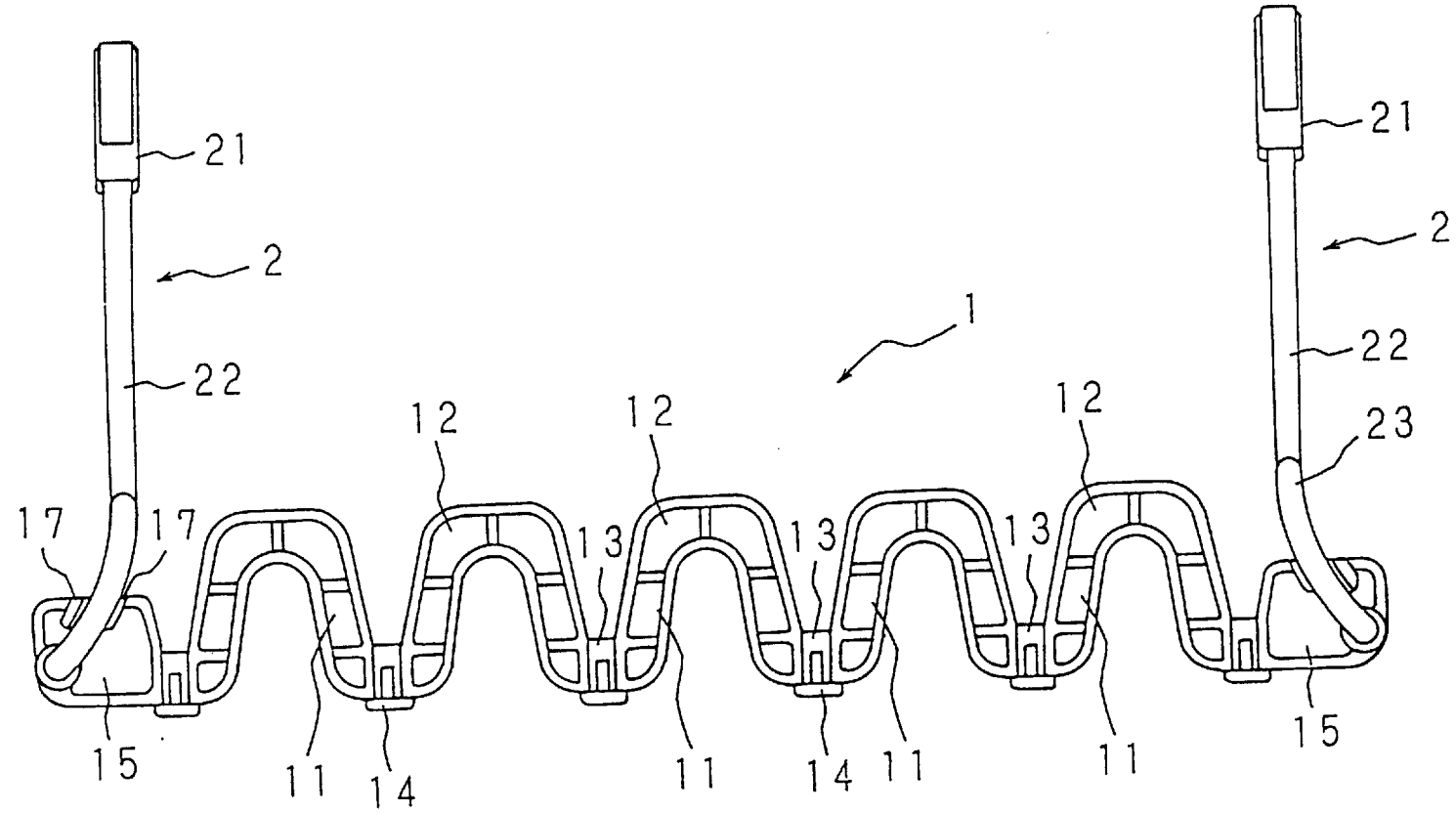
FIG. 3 is a rear side view for showing the structure of the hanger bar.
Figure 4:
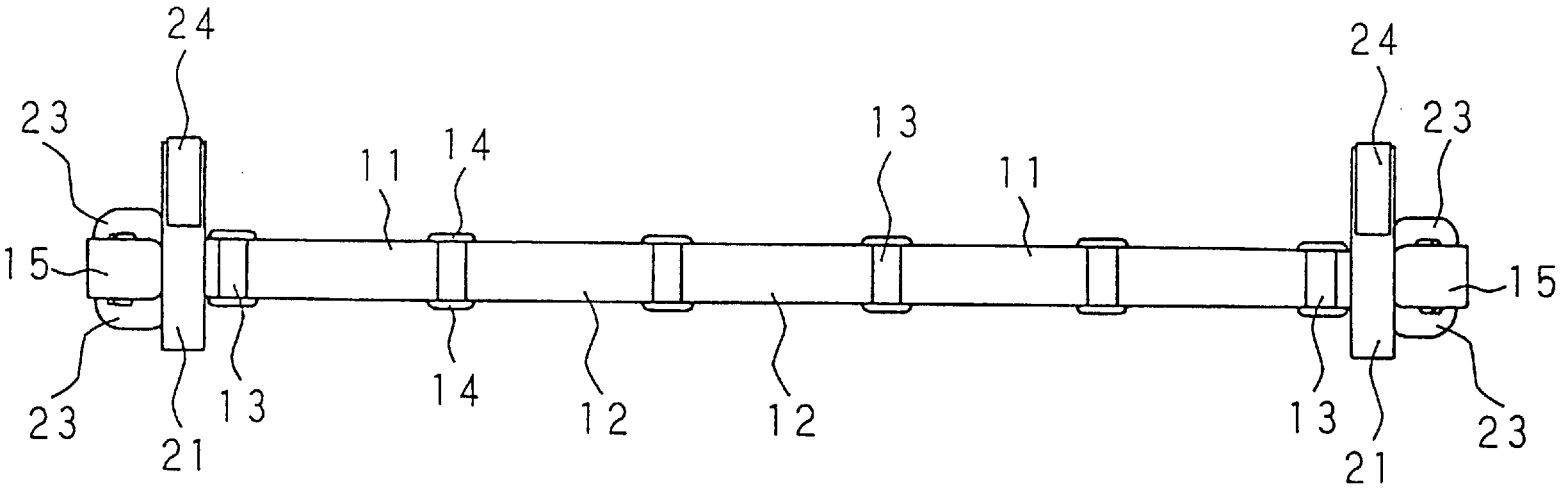
FIG. 4 is a plan view for showing the structure of the hanger bar.
Figure 5:
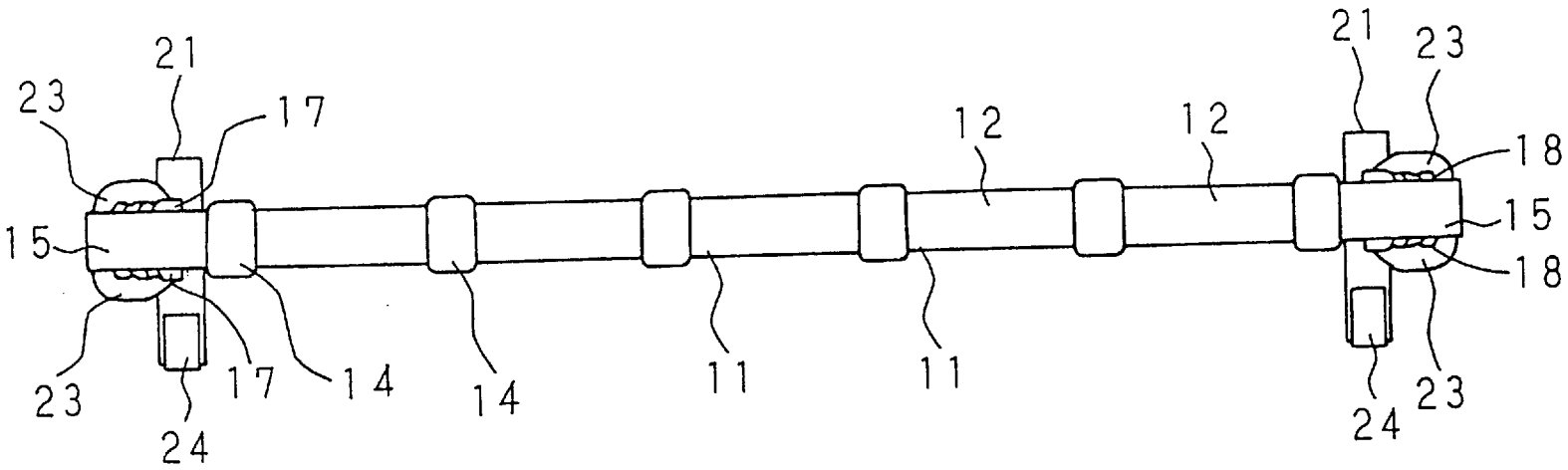
FIG. 5 is a bottom view for showing the structure of the hanger bar.
Figure 6:
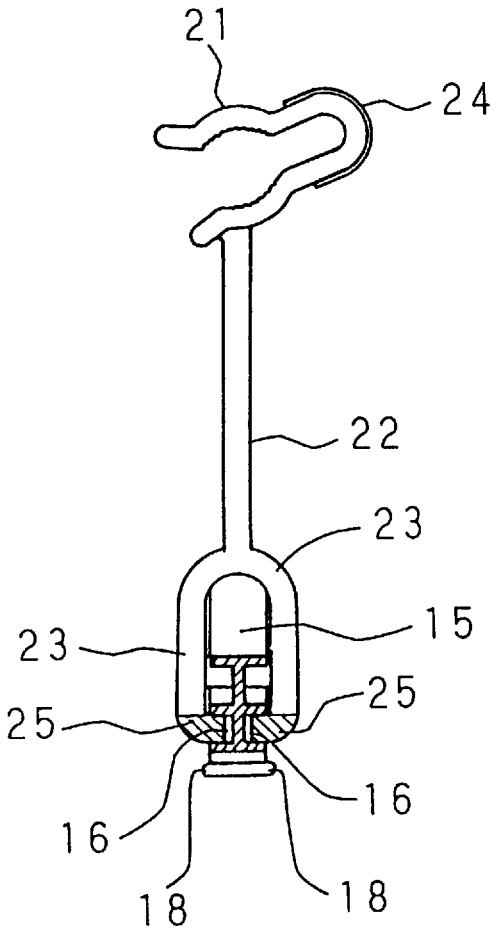
FIG. 6 is a sectional view taken on line VI—VI of FIG. 1.
Figure 7:
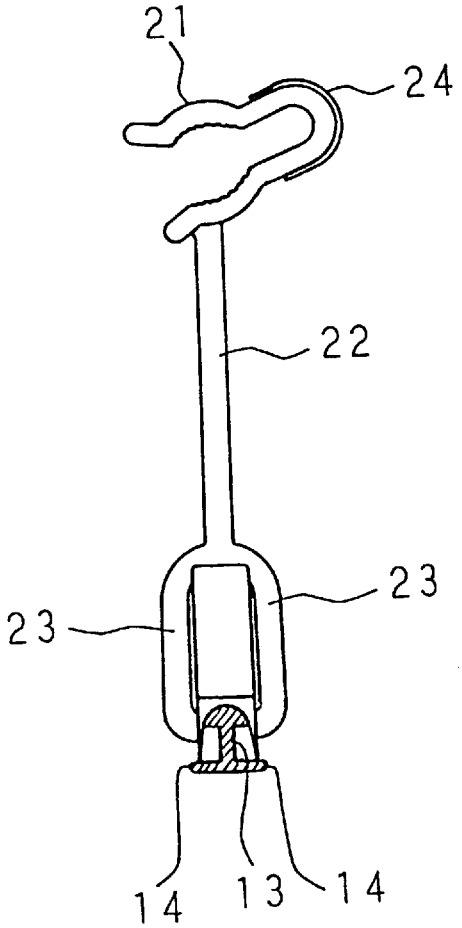
FIG. 7 is a sectional view taken on line VII—VII of FIG. 1.
Figure 8:
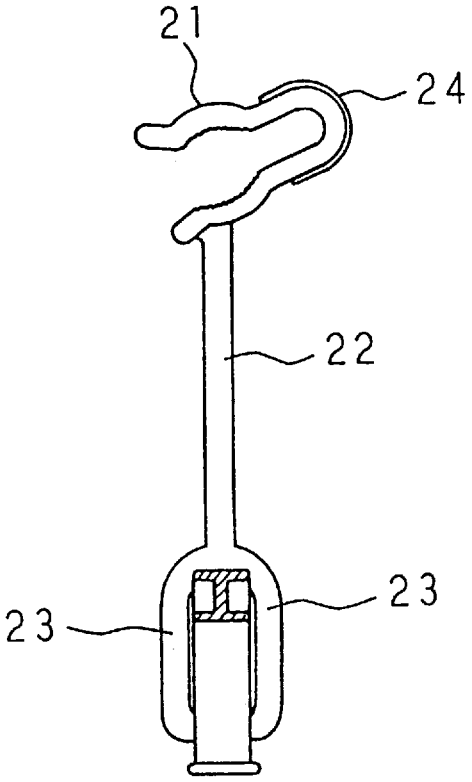
FIG. 8 is a sectional view taken on line VIII—VIII of FIG. 1.
Figure 9:
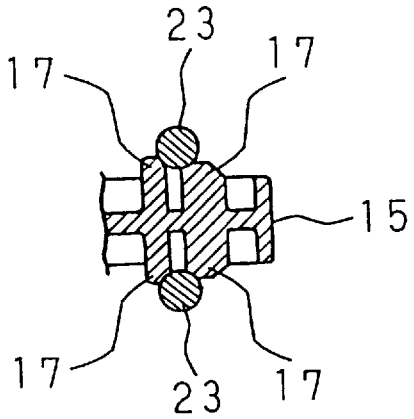
FIG. 9 is a sectional view taken on line IX—IX of FIG. 1.
Figure 10:
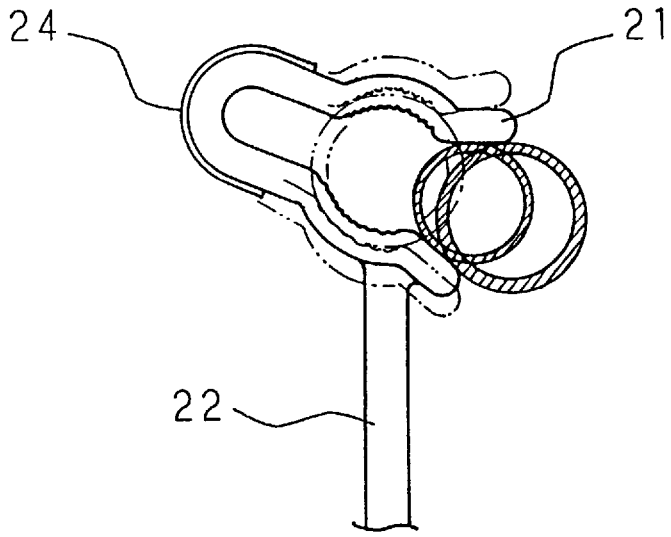
FIG. 10 is a left side view for showing the structure of a clipping part of the hanger bar.

Each suspending member 2 is made of a synthetic resin such as polypropylene, and is integrally formed so as to include a post 22 having a clipping part 21 for clipping a bar at the upper end and a leg part 23 to be linked with the hanging member 1 at the lower end, as is shown in FIGS. 1 and 2. The clipping part 21 has substantially a lateral U-shape having clipping pieces with its opening facing backward (or forward). On the lower face near the lower end of the clipping part 21, the upper end of the post 22 is fixed. Each clipping piece of the clipping part 21 round out at substantially a center thereof, and a plurality of grooves extending in the lateral direction are formed on the inner face of the round portion for preventing slip. The tip portions of the clipping pieces are curved outward. FIG. 10 is a left side view for showing the structure of the clipping part 21. Since the clipping part 21 is formed in the U-shape out of a synthetic resin such as polypropylene, it has a material elasticity, resulting in flexibility in a direction to make the clipping pieces closer to and farther from each other. Owing to this flexibility, the clipping part 21 can be applied to various bars with different diameters (shown as hatched areas in FIG. 10). Furthermore, on the outer face of the U-shaped bottom of the clipping part 21, a U-shaped flat spring 24 of steel in the shape fittable to the U-shaped bottom is removably fit. After clipping a bar with the clipping part 21, the U-shaped flat spring 24 is fit, thereby further enforcing the fixation of the suspending member 2 on the bar.

The leg part 23 of the suspending member 2 is divided into two in the back-and-forth direction at the lower end of the post 22, and the divided portions are bent in the lateral direction. At the lower end of each divided portion of the leg part 23, and engaging protrusion 25 is formed by bending the tip of the divided portion in a direction toward the other opposing divided portion. These engaging protrusions 25 are substantially fit in the engaging holes 16, so that the suspending member 2 can be linked with the hanging member 1 rotatably with the engaging protrusions 25 as an axis. Each engaging protrusion 25 has a height corresponding to the depth of the engaging hole 16. Since the leg part 23 is made of a synthetic resin, it has a material elasticity, resulting in flexibility in a direction to make the engaging protrusions 25 closer to and farther from each other. This flexibility allows the leg part 23 to be fit in and released from the engaging holes 16.

In the hanger bar having the aforementioned structure, the suspending members 2 are rotatably linked with the hanging member 1, and hence, the shape of the hanger bar can be changed through the rotation of the suspending members 2 in accordance with the cases where the hanger bar is used and is stored. The states of the hanger bar for the usage and the storage will now be described.

In using the hanger bar, the suspending members 2 are locked by fitting in the first latching click pairs 17 as is shown in FIG. 1. At this point, the recesses 11 of the hanging member 1 have their openings upward, and the suspending members 2 are linked with the linking parts 15 of the hanging member 1 with the posts 22 extending in the vertical direction and with the leg parts 23 bend toward the center of the hanging member 1. The first latching click pairs 17 are disposed at positions suitable for catching the bent leg parts 23, with the outer latching click 17 formed at a lower portion than the inner latching click 17 in their projecting direction. Thus, the leg part 23 of the suspending member 2 moves beyond the outer latching click 17 so as to be stopped by the inner latching click 17. Since the suspending members 2 are locked, the hanger bar can be stably suspended.

Figure 11:
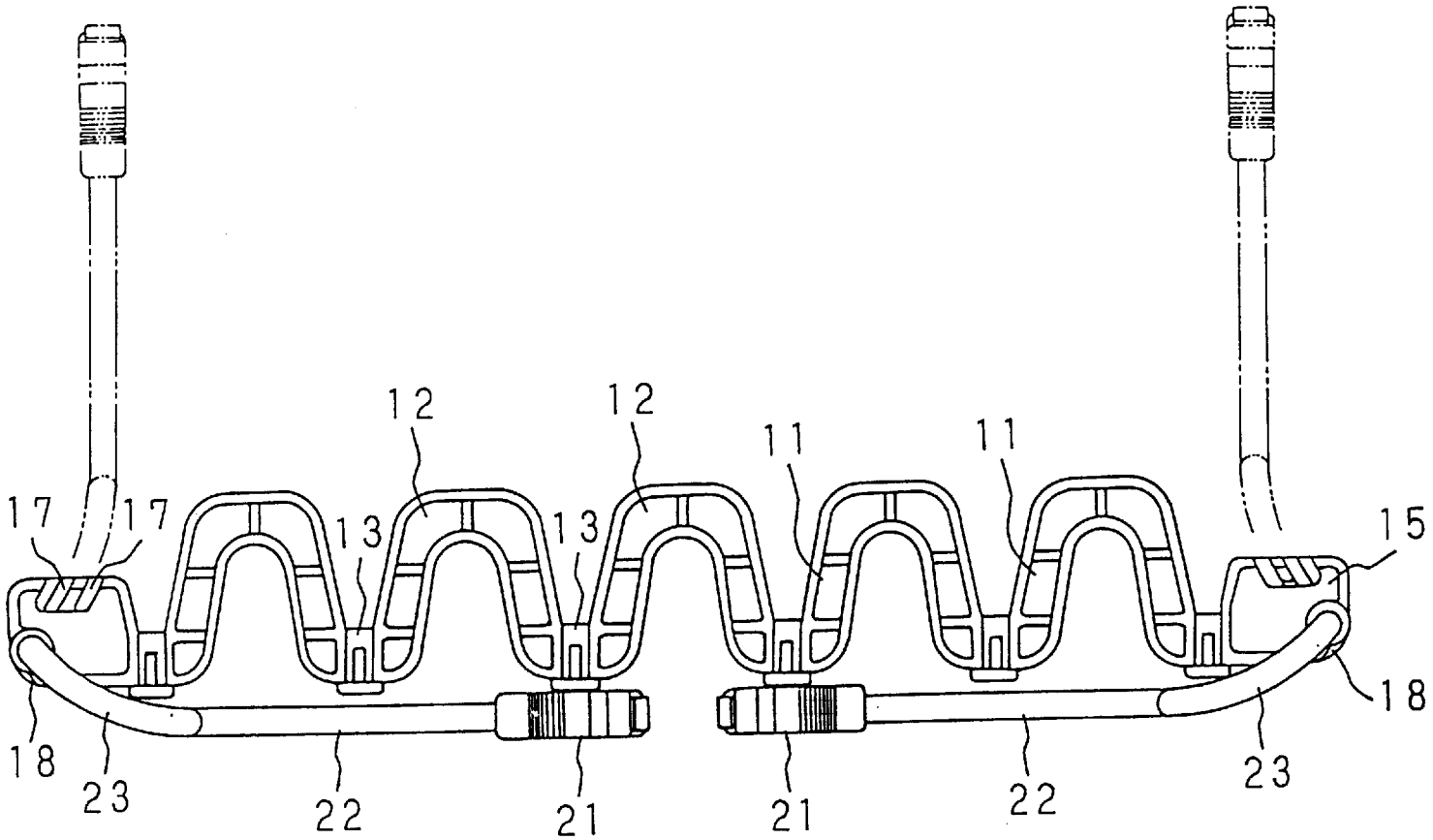
FIG. 11 is a front view for showing a state of the hanger bar for storage.

FIG. 11 is a front view for showing the state for storing the hanger bar. From the state shown in FIG. 1, the suspending members 2 are rotated with the engaging protrusions 25 as the axes, and the suspending members 2 move beyond the second latching clicks 18 to be locked as is shonwn in FIG. 11. At this point, the leg parts 23 are bent downward so that the posts 22 and the clipping parts 21 can lie along the bottom faces of the engaging projections 13. The suspending members 2 extend along the same direction as the hanging member 1, and thus, the hanger bar can be changed into a compact shape easily stored and requiring a small space. When the hanger bar is placed in such a state for the storage, the coveyance can be also eased.

Figure 12:
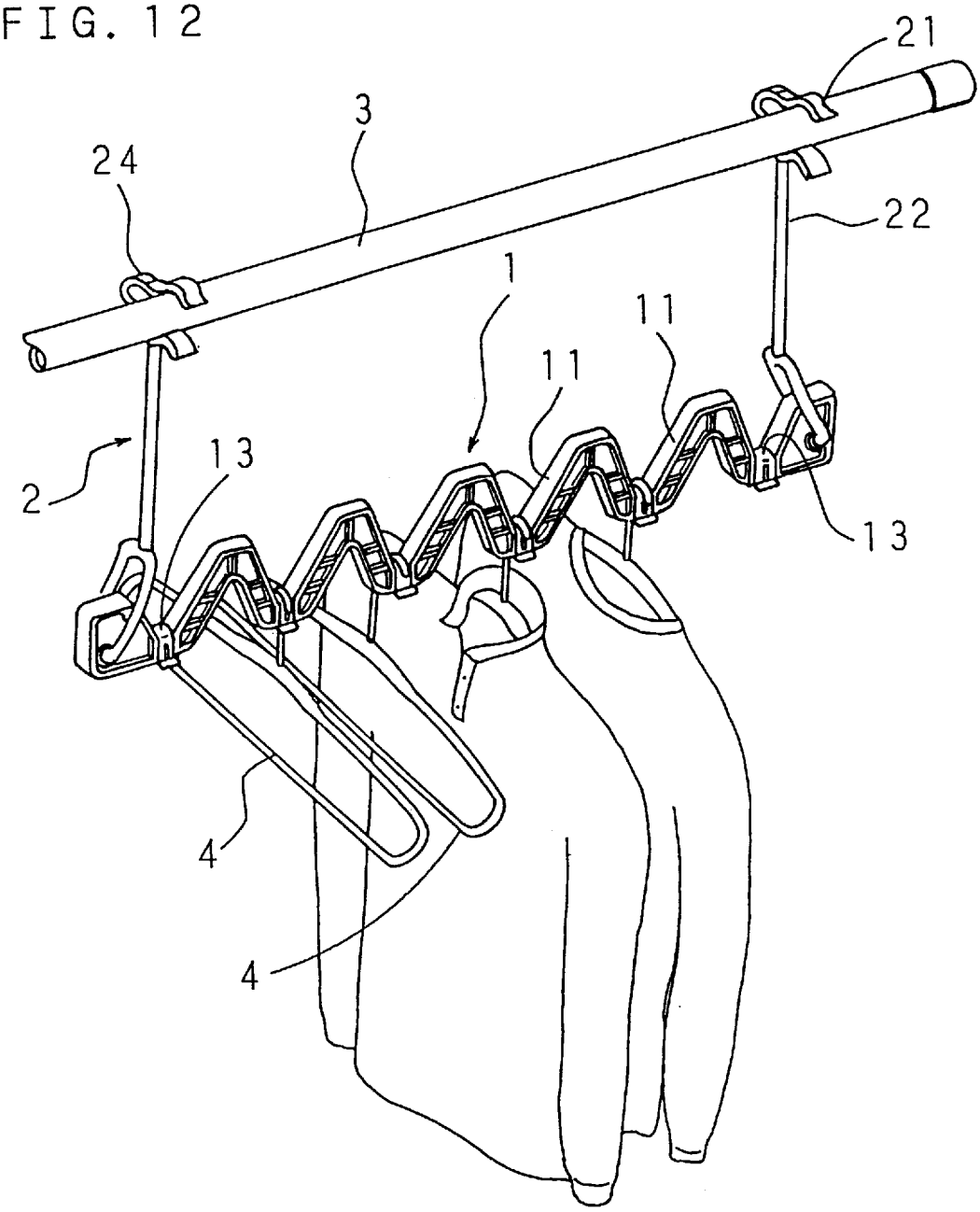
FIG. 12 is a perspective view for showing first usage of the hanger bar.
Figure 13:
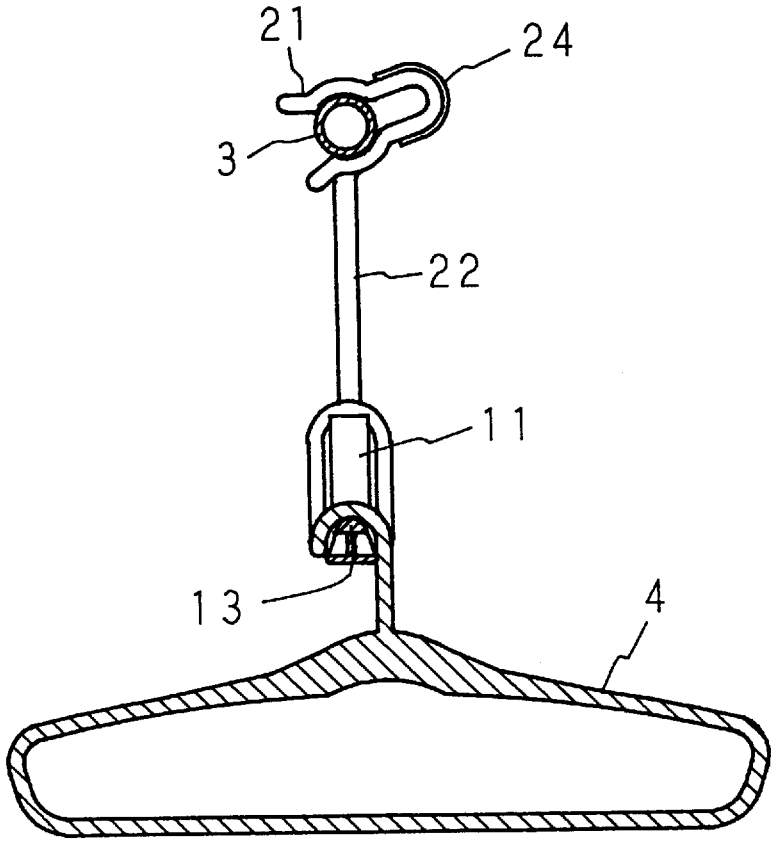
FIG. 13 is a sectional view taken from the right side of an engaging projection of FIG. 12.

Now, specific usage of the present hanger bar will be described. FIG. 12 is a perspective view for showing first usage, and FIG. 13 is a sectional view taken from the right side of the engaging projection 13 of FIG. 12. A clothes-drying bar 3 is clipped with the clipping parts 21, and the U-shaped flat springs 24 are fit on the clipping parts 21, thereby fixing the hanger bar on the clothes-drying bar 3. At this point, since the tips of the clipping pieces of each clipping part 21 are curved outward, the clothes-drying bar 3 can be easily guided to the center of each clipping part 21 even when the clothes-drying bar 3 has a large diameter. Hooked head portions of hangers 4 are caught by the respective engaging projections 13, and garments and the like to be dried are hung on the hangers 4.

When this hanger bar is used, the hangers 4 stay in the respective recesses 11 against a wind, without being gathered in an end portion of the hanger bar, resulting in attaining good airing and shortening drying time. In addition, since the collar of the garment hung on each hanger 4 can be settled within the opening of the recess 11, the collar is prevented from being spoiled in the shape. Moreover, since the peripheral face of each engaging projection 13 extends in a direction perpendicular to the alignment of the recesses 11, the hooked head portions of the hangers can be stably caught. Furthermore, since the suspending members 2 can be rotated to have the clipping parts 21 and the posts 22 lie on the bottom face of the hanging member 1 in the lengthwise direction thereof, the space required for storing the hanger bar can be smaller than the space occupied by the hanger bar in use.

Figure 14:
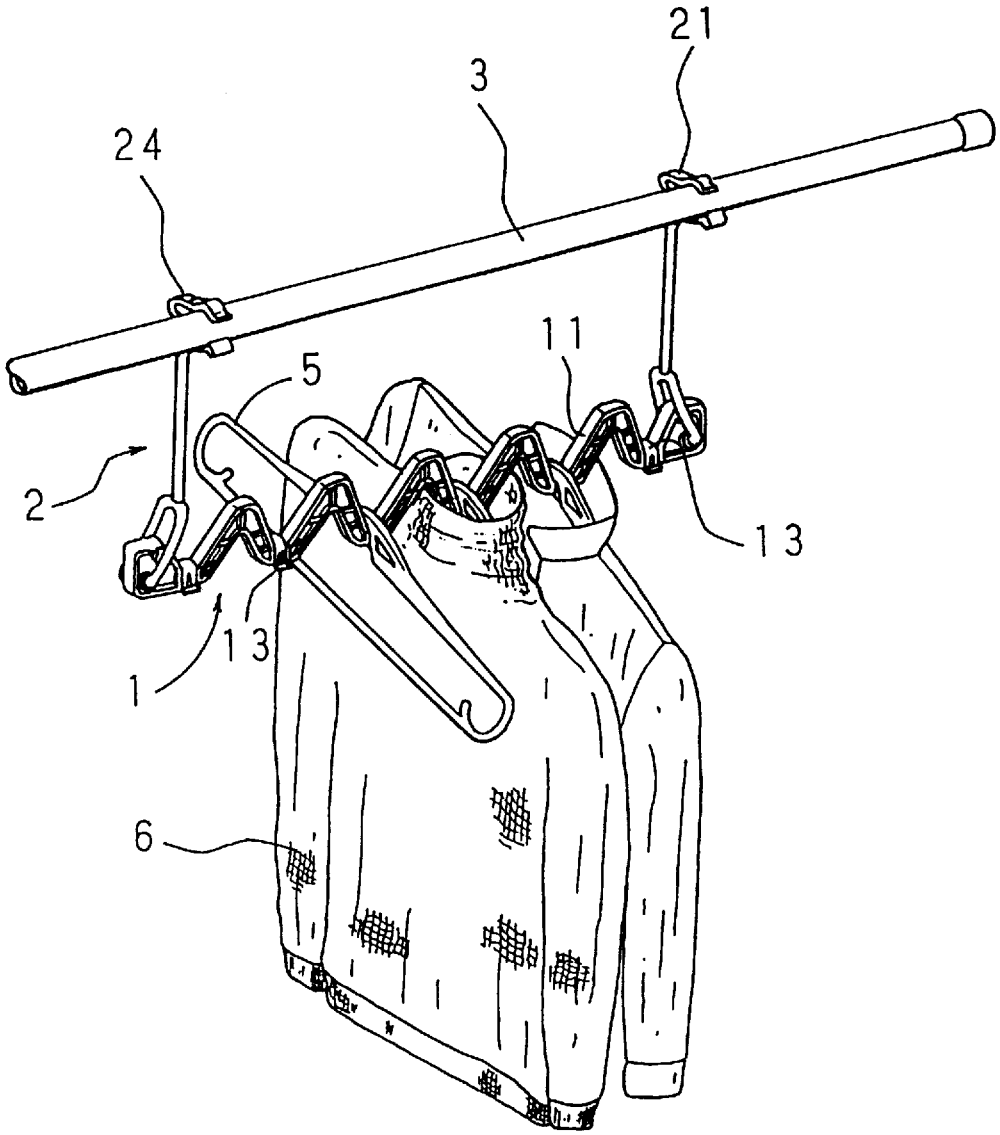
FIG. 14 is a perspective view for showing second usage of the hanger bar.
Figure 15:
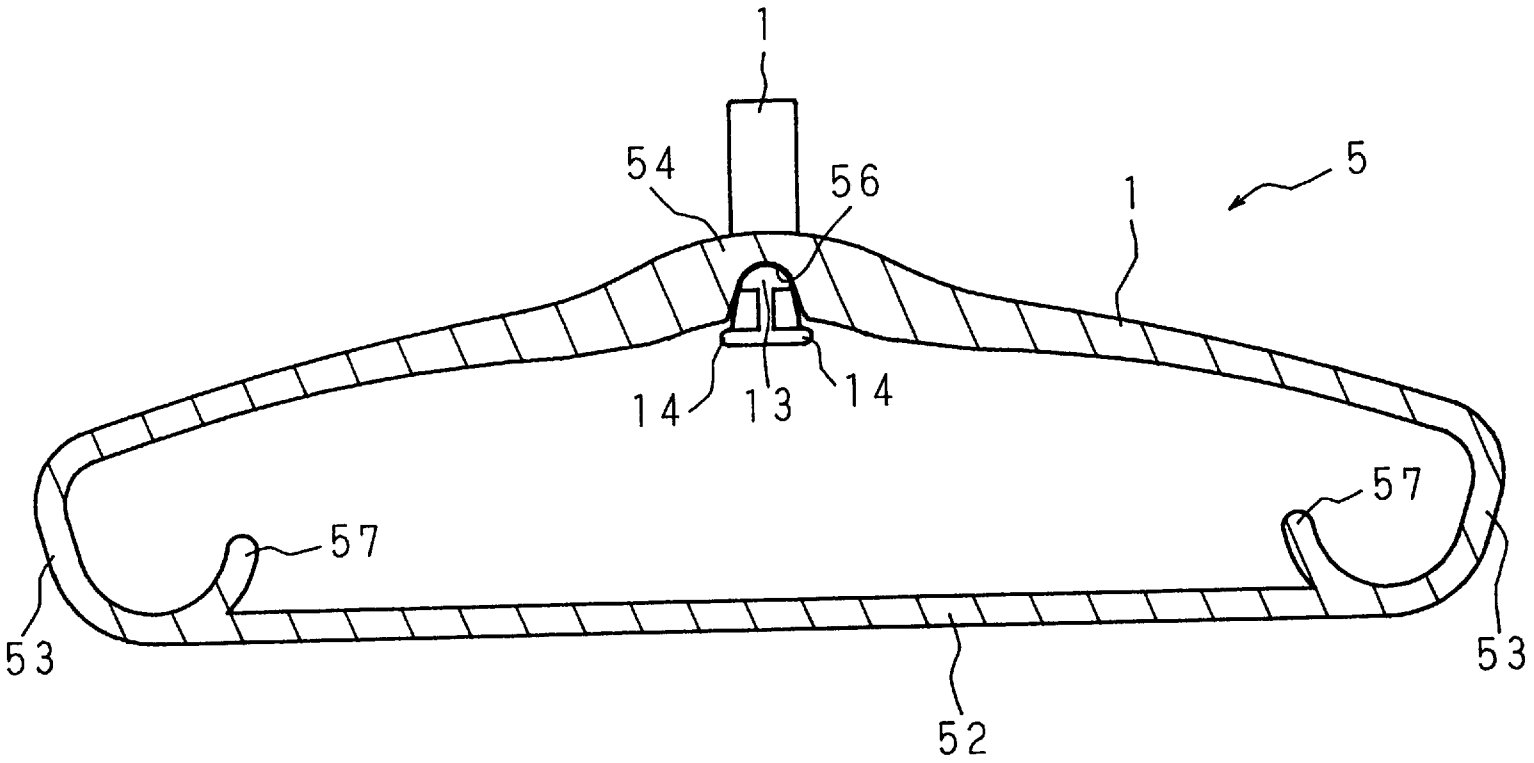
FIG. 15 is a sectional view taken from the right side of an engaging projection of FIG. 14.

FIG. 14 is a perspective view for showing second usage of the hanger bar. FIG. 15 is a sectional view taken from the right side of the engaging projection 13 of FIG. 14, wherein the suspending member 2 and the clothes-drying bar 3 are omitted. As is shown in FIG. 14, the clothes-drying bar is clipped with the clipping parts 21, and the U-shaped flat springs 24 are fit on the clipping parts 21, thereby fixing the hanger bar on the clothes-drying bar 3. Hangers 5 described below are hung on the engaging projections 13, and garments to be dried, for example, sweaters 6 are hung on the hangers 5.

The hanger 5 is made of a synthetic resin such as polypropylene, and has a flame-shape similar to the hanger part of a general hanger as is shown in FIG. 15. An upper hanger part 51, that is, one side of the frame, is slightly bent at the center thereof so as to extend along a line between the neck and the shoulder of a garment to be hung. In the upper hanger part 51, a first catching portion 54, corresponding to the peak of its bent shape, has a larger width in the vertical direction than both end portions of the upper hanger part 51. The catching portion 54 includes a catching recess 56 in a reverse U-shape with its opening facing downward, and the catching recess 56 has a smaller depth than the height of the engaging projection 13. A lower hanger part 52 opposing the upper hanger part 51 is formed in the shape of a straight bar. Side parts 53, that is, second catching portions, opposing each other so as to link the upper hanger part 51 with the lower hanger part 52, have a shorter length than the upper hanger part 51 and the lower hanger part 52.

The neck and the shoulders of the garment are in contact with and hung on the upper hanger part 51, and the lower hanger part 52 can be used for hanging trousers, a towel or the like. The lower hanger part 52 has upward projections 57 at its both ends with a distance therebetween approximately equal to a width of a skirt. For example, a skirt can be suspended by catching the projections 57 with loops attached to the skirt. The thickness of the hanger 5 is slightly smaller than the thickness of the engaging projection 13. The hanging member 1 is inserted into the frame of such a hanger 5, so that the catching recess 56 catches and is supported by the engaging projection 13. Thus, the hanger 5 is set on the hanger bar.

Figure 16:
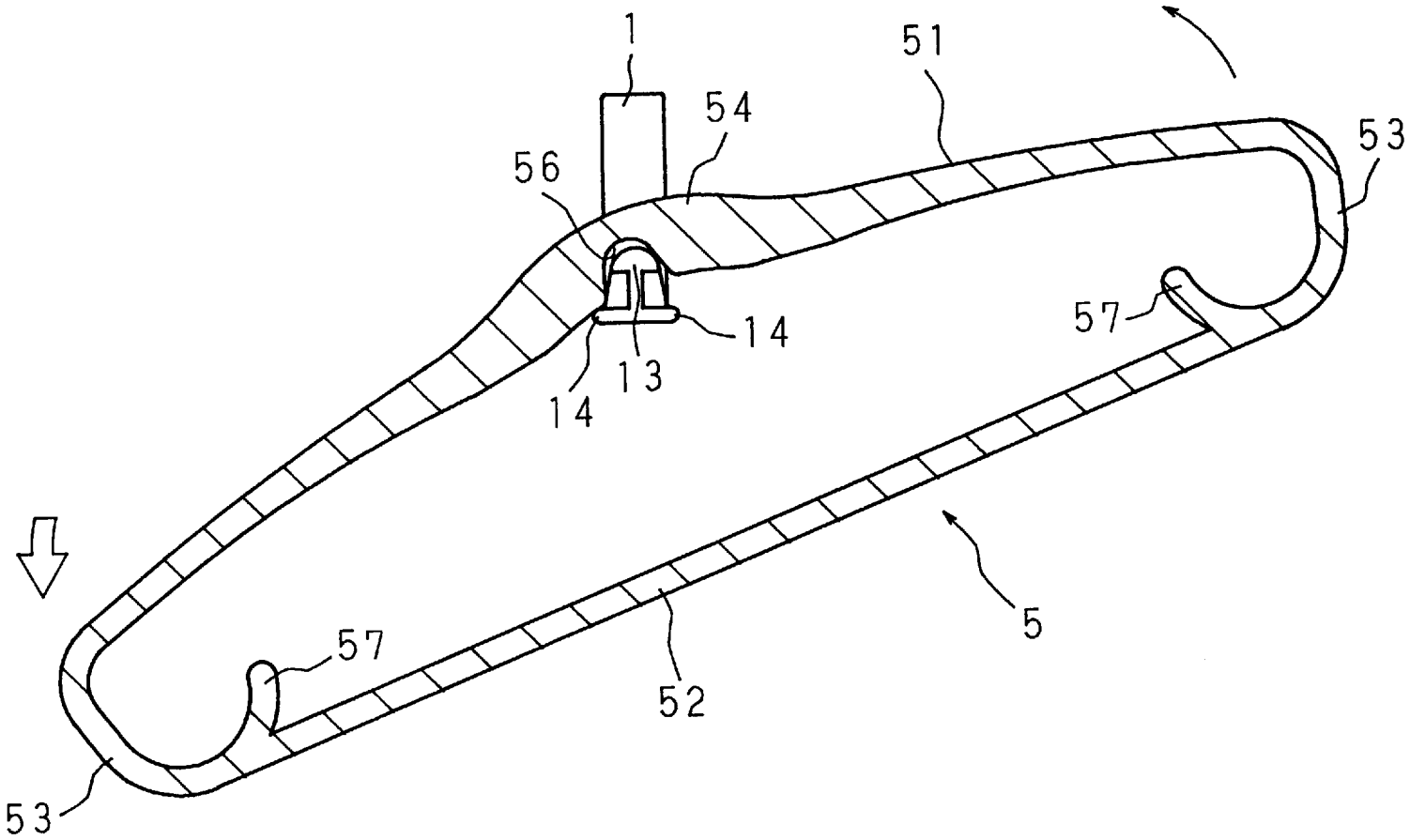
FIG. 16 is a sectional view for showing engagement and release between the engaging projection and a catching recess in the second usage.
Figure 17:
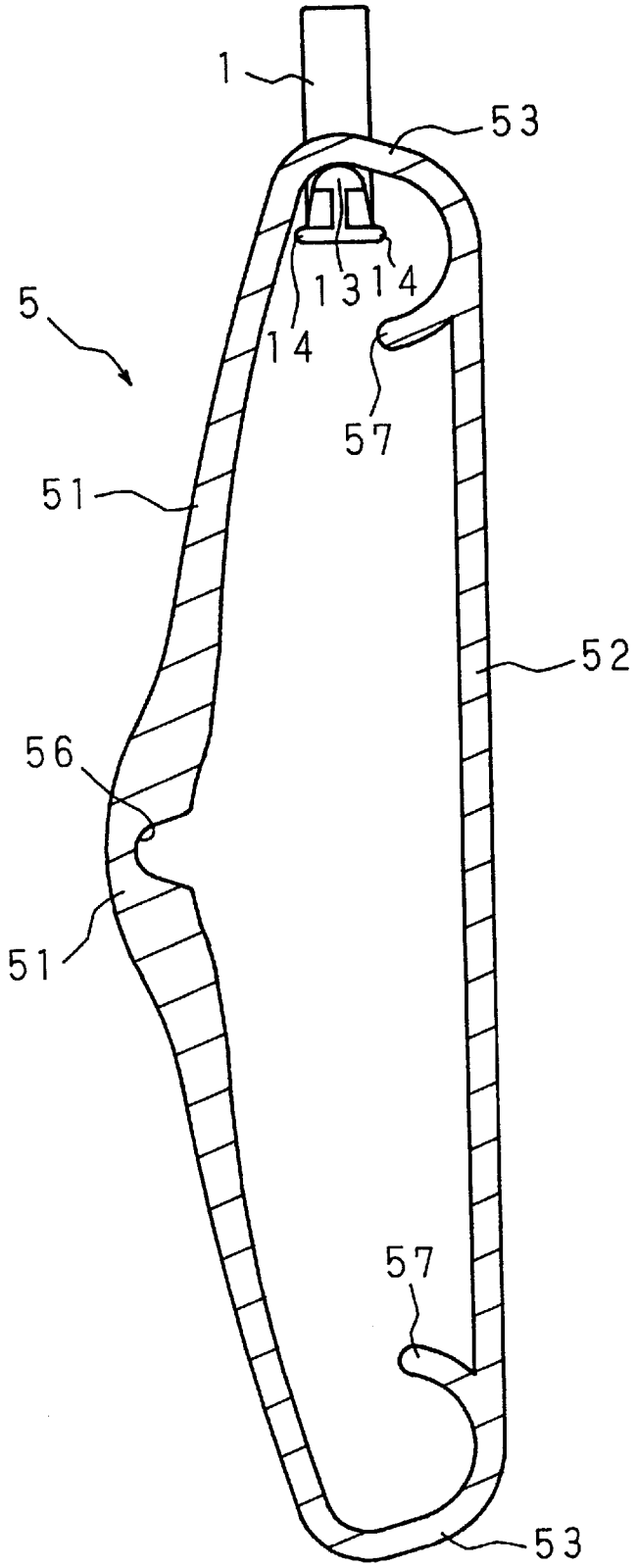
FIG. 17 is another sectional view for showing the engagement and release between the engaging projection and the catching recess in the second usage.

The engaging projection 13 and the catching recess 56 can be engaged with and released from each other. FIGS. 16 and 17 are sectional views for showing engagement and release between the engaging projection 13 and the catching recess 56. As is shown in FIG. 15, the catching recess 56 catches the engaging projection 13, so that the hanger 5 is supported to extend in the lateral direction. The engaging projection 13 has, in a sectional view, an arc-shaped top portion and a trapezoid base portion with a larger width toward its bottom, and similarly, the catching recess 56 has an arc-shaped bottom portion and a trapezoid opening with a larger width toward its edge. Since the catching recess 56 has a depth larger than the height of the engaging projection 13 as described above, the engaging projection 13 supports the bottom of the catching recess 56 at its top, with the edge of the catching recess 56 not in contact with the rotation supporting pieces 14.

The engagement between the engaging projection 13 and the catching recess 56 can be released by rotating the hanger 5. When a small force is applied to the side part 53, the catching portion 54 can be swung. When a downward force is applied to the left side part 53, the hanger 5 is rotated in the counterclockwise direction as is shown in FIG. 16, and the left edge of the catching recess 56 comes in contact with the rotation supporting piece 14 of the engaging projection 13. When the downward force is further applied to the left side part 53, the catching recess 56 is rotated in the counterclockwise direction with the rotation supporting piece 14 as a fulcrum, so that the right edge of the catching recess 56 moves beyond the top of the engaging projection 13. When the catching recess 56 is further rotated, the left edge of the catching recess 56 moves away from the rotation supporting piece 14, that is, the fulcrum, and the hanger 5 is moved downward as is shown in FIG. 17, so that the right side part 53 catches the engaging projection 13. At this point, the hanger 5 is supported by the engaging projection 13 so as to extend in the longitudinal direction with the short side parts 53 positioned at the lower and higher ends thereof.

In returning the state of the hanger 5 from the state where the side part 53 is engaged with the engaging projection 13 to the state where the hanger 5 is supported to extend in the lateral direction as is shown in FIG. 15, an upward force is applied to the hanger 5, so that the upper hanger part 51 is slid on the engaging projection 13. When the catching recess 56 catches the engaging projection 13, the upward force is released, and thus the catching recess 56 is engaged with the engaging projection 13. In moving the hanger 5 upward, there is no need to slide the upper hanger part 51 on the engaging projection 13, but the hanger 5 can be moved to an extent that the hanger 5 does not move to the adjacent recess 11. Furthermore, the hanger 5 is rotated in the counterclockwise direction to release the engagement between the engaging projection 13 and the catching recess 56 in the above description, but the engagement can be also released through clockwise rotation.

Figure 18:
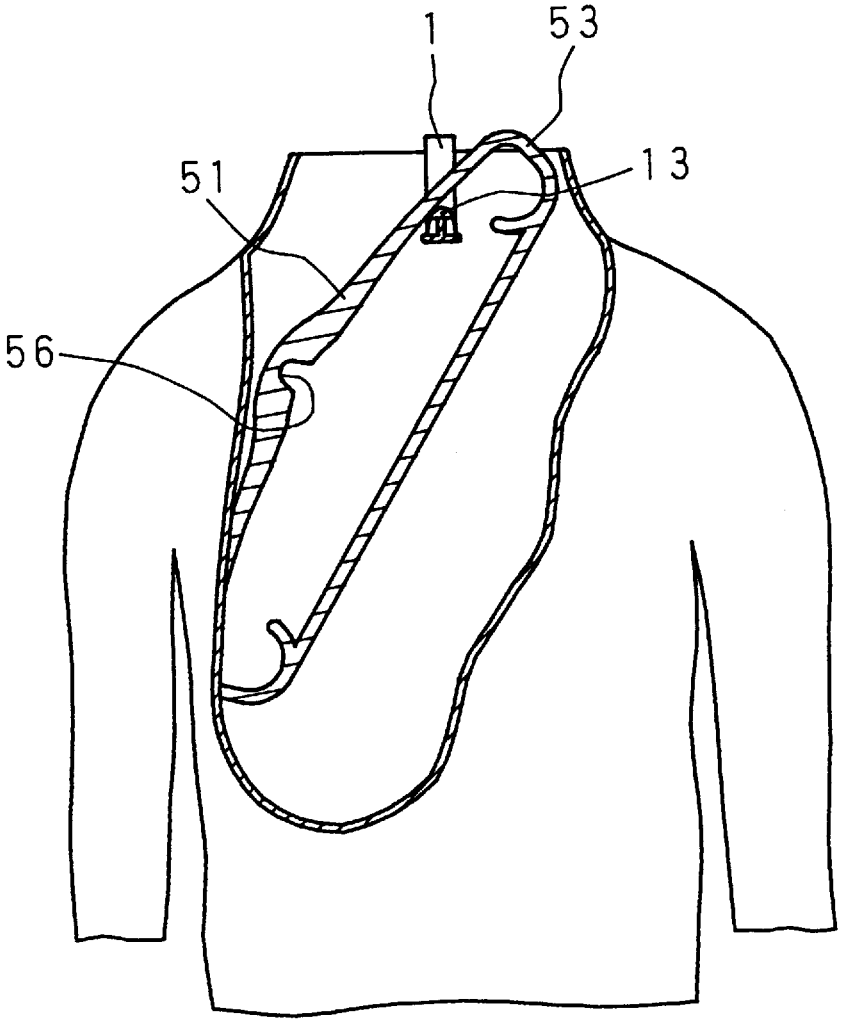
FIG. 18 is a diagram for illustrating the way to hang a sweater on a hanger.

When a garment such as the sweater 6 is to be hung on the hanger 5, the hanger 5 is first supported by the engaging projection 13 so as to extend in the longitudinal direction. The side part 53 at the lower end of the hanger 5 is first inserted through the neck of the sweater 6, and the sweater 6 is moved upward. At this point, the sweater, which has just been washed, is heavy and tensionless, but the hanger 5 can be smoothly inserted through the neck because the side part 53 has a small width. FIG. 18 illustrates the way to hang the sweater 6 on the hanger 5. After inserting the entire hanger 5 into the sweater 6, the sweater 6 and the side parts 53 of the hanger 5 are together grasped with hands and pushed upward, thereby sliding the upper hanger part 51 on the engaging projection 13. When the catching recess 56 catches the engaging projection 13, the movement of the hanger 5 is stopped, and the hands are removed from the hanger 5. Thus, the hanger 5 can be supported as is shown in FIG. 15.

In removing the sweater 6 from the hanger 5, the procedures are reversed. Specifically, the right or left side part of the hanger 5 is pushed downward, so that the hanger 5 is rotated and the engagement between the catching recess 56 and the engaging projection 13 is released. The hanger 5 is then moved downward until the side part 53 catches the engaging projection 13, so that the hanger 5 is supported by the engaging projection 13 so as to extend in the longitudinal direction. After attaining this state, the sweater 6 is moved downward, and the hanger 5 is pulled out of the sweater 6 through the neck.

Also, by slightly pulling the neck of the sweater 6 in the rightward or leftward direction, the sweater 6 can be removed from the hanger 5. For example, when the neck of the sweater is pulled in the leftward (or rightward) direction, a downward force is applied to the right portion of the upper hanger part 51, so that the hanger 5 is rotated in the clockwise direction and the engagement between the catching recess 56 and the engaging projection 13 is released. Thereafter, the sweater 6 can be removed from the hanger 5 in the same manner as described above.

In this manner, such a hanger can achieve the same effects as those exhibited by the first usage described above.

Furthermore, since the side part 53 with a small width of the hanger 5 can be inserted through the neck, the neck of the garment is prevented from being stretched. Also, since the hanger 5 can be smoothly rotated, and object to be hung can be hung on and removed from the hanger 5 in a short period of time. In addition, since the state where the hanger 5 is supported to extend in the longitudinal direction can be retained without applying any force to the hanger 5, the operation to hang a garment on the hanger can be conducted by using both hands.

In the first and second usage, the clothes-drying bar 3 is clipped with the openings of the recesses 11 facing upward. However, the hanger bar can be set with the openings of the recesses 11 and 12 facing forward and backward in clipping the bar with the clipping parts 21. In other words, the hanger bar can be fixed on a bar with the posts 22 of the suspending members 2 extending in the horizontal direction. In such a case, a part of the bar sandwiched between the clipping parts 21 can be used to suspend other hangers, resulting in improving efficiency is suspending the hangers.

In the above description, the hanging member 1 and the suspending members 2 are made of a synthetic resin such as polypropylene, but the material for these members is not limited to the synthetic resin but can be any material which is light and does not rust easily.

Furthermore, a hanger used in the present hanger bar is not limited to the hanger 5 having the structure described referring to the second usage above. For example, as described referring to the first usage, a generally available hanger can be applied to the hanger bar. In addition, the hanger 5 is not necessarily provided with the side parts 53, that is, the catching portions, at both ends of the upper hanger part 51, but the upper hanger part 51 can be provided with merely one side part.

Moreover, in the above description, in hanging the suspending members 2 on a clothes-drying bar, the U-shaped flat spring 24 having the shape to fit on the U-shaped bottom of the clipping part 21 is fit on the clipping part 21, thereby fixing the clip of the clipping part 21 on the bar. However, this does not limit the invention. For example, the suspending member 2 can be integrally formed so that the clipping part 21 has a U-shaped bottom with a larger thickness than the tip portions of the U-shape, thereby attaining the same effect resulting from the U-shaped flat spring 24 fit on the clipping part 21 as is shown in FIG. 2.

Figure 19:
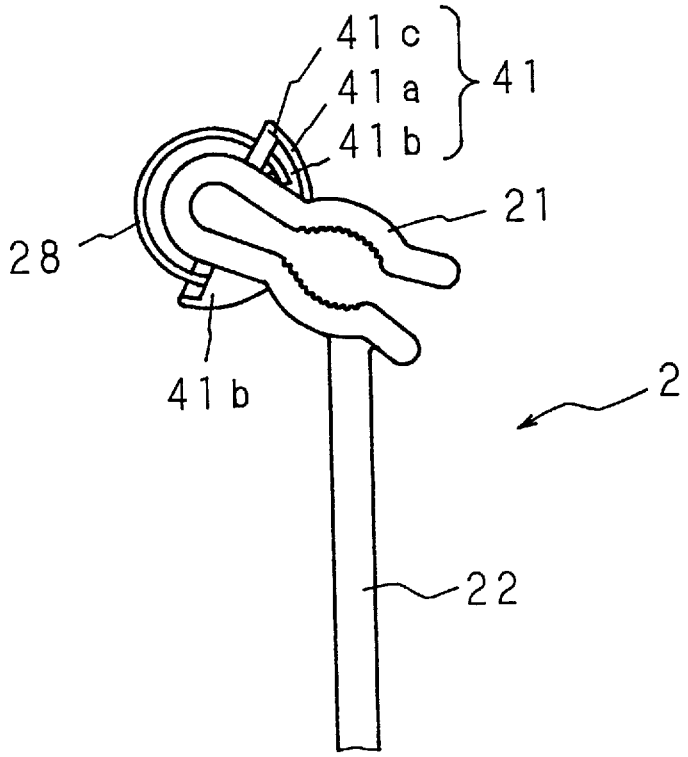
FIG. 19 is a left side view for showing the structure of another suspending member of the invention.
Figure 20:
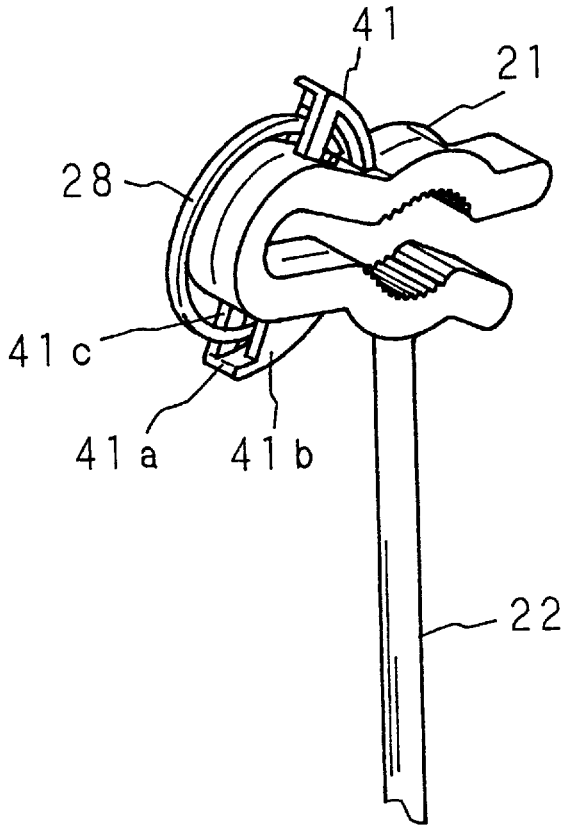
FIG. 20 is a perspective view for showing the structure of the suspending member of FIG. 19.
Figure 21:
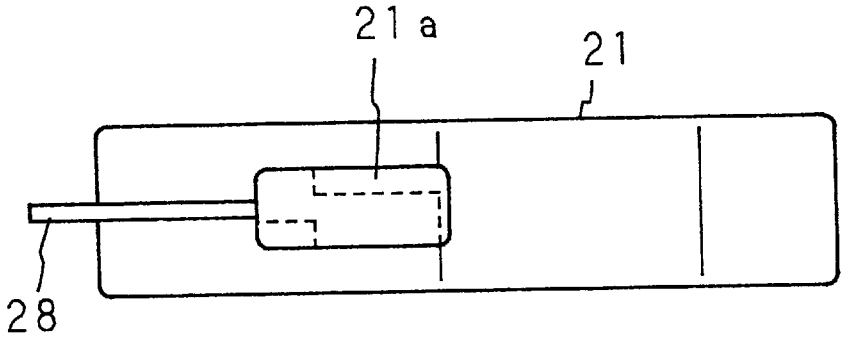
FIG. 21 is a plan view for showing the structure of the suspending member of FIG. 19.
Figure 22:
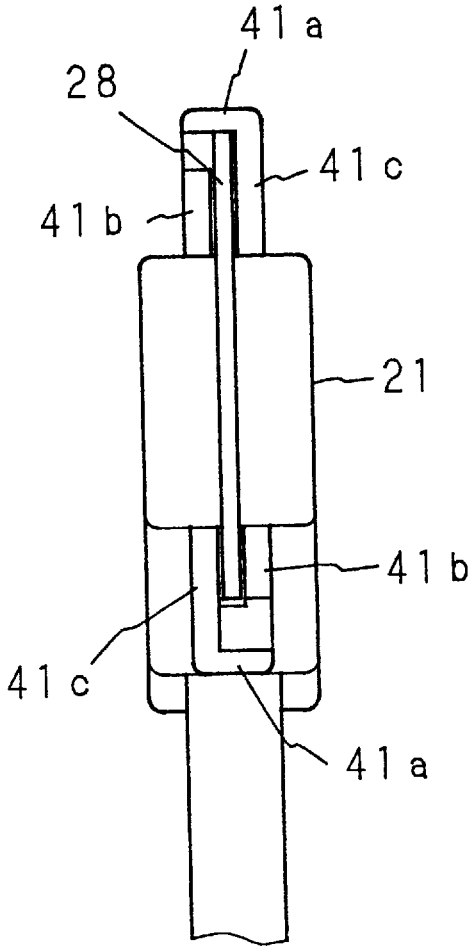
FIG. 22 is a rear side view for showing the suspending member of FIG. 19.

In addition, in order to further enforce the fixation of the suspending members 2 on a clothes-drying bar, the clipping part 21 can be provided with the following structure: FIG. 19 is a right side view for showing this other structure of the suspending member, FIG. 20 is a perspective view thereof, FIG. 21 is a plan view thereof, and FIG. 22 is a rear side view thereof, wherein merely one suspending member 2 is shown with the leg part 23 omitted. As is shown in FIGS. 19 through 22, the suspending member 2 is integrally formed with the clipping part 21 having spring bearing pieces 41, each having a substantially fan-shape in a side view, projecting outward from the upper and lower faces of the clipping pieces, and a split ring spring 28 is set on the spring bearing pieces 41.

Each of the spring bearing pieces 41 has a stop portion 41*a* formed by projecting the curve portion of the clipping part 21 corresponding to the arc of the fan-shape, namely, the concave curve portion formed toward the bottom of the U-shape, from the upper or lower face of each clipping piece, and also has first and second restricting portions 41*b* and 41*c* each having a face formed along the lengthwise direction of the clipping piece and respectively projected rightward and leftward at different positions in the lengthwise direction. The first restricting portion 41*b* of each spring bearing piece 41 is disposed closer to the center of the clipping part 21, and the second restricting portion 41*c* of each spring bearing piece 41 is disposed closer to the U-shaped bottom of the clipping part 21. The upper portions of the first and second restricting portions butt against and are integrated with the stop portion 41*a*. Between the first restricting portion 41*b* and the second restricting portion 41*c*, there is a space with a predetermined length in the lateral direction. Furthermore, the first restricting portion 41*b* of one of the two spring bearing pieces 41 is disposed on the rear face, and the first restricting portion 41*b* of the other spring bearing piece 41 is disposed on the front face. Similarly, the second restricting portion 41*c* of the former spring bearing piece is disposed on the front face and the second restricting portion 41*c* of the latter spring bearing piece is disposed on the rear face.

The split ring spring 28 is an elastic member formed by bending a metallic wire material, which has a diameter substantially the same as the space between the first and second restricting portions 41*b* and 41*c*, in a C-shape. With the center of the ring spring 28 disposed along the U-shaped bottom, the tip portions of the C-shaped ring spring 28 are respectively inserted into the spaces in the spring bearing pieces 41 so as to be in contact with the stop portions 41*a*. Thus, the split ring spring 28 is supported by the spring bearing pieces 41 so as to be fixed on the U-shaped bottom of the clipping part 21, thereby applying a force to the clipping part 21 in a direction to make the clipping pieces closer to each other. The remaining structure of this suspending member 2 is the same as that of the suspending member 2 shown in FIG. 2, and hence, like reference numerals are used to refer to like elements, and the description is omitted. Since the positions of the first and second restricting portions 41*b* and 41*c* are shifted in the lengthwise direction of the clipping pieces, the split ring spring 28 can be inserted with ease. Moreover, since the first and second restricting portions 41*b* and 41*c* of the respective spring bearing pieces 41 are disposed on the different faces, i.e., one on the front face and the other on the rear face, the restriction of the split ring spring 28 in the widthwise direction of the clipping pieces can be further enhanced.

Figure 23:
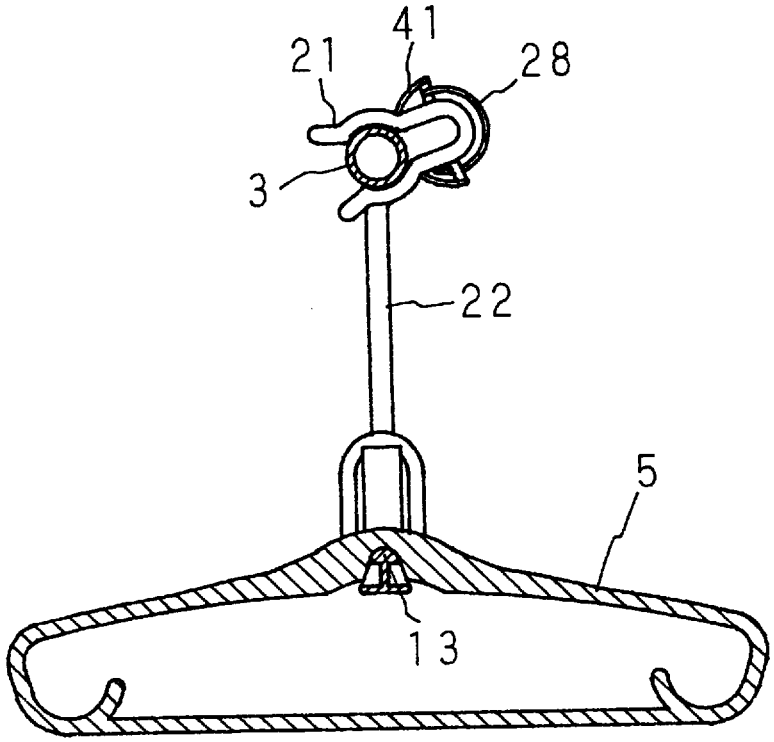
FIG. 23 is a sectional view for showing usage of a hanger adopting the suspending member of FIG. 19.

When such a suspending member 2 is used to suspend the present hanger bar on a clothes-drying bar or the like, various types of bars with different diameters can be used. FIG. 23 is a sectional view for showing a state where the suspending member 2 provided with the split ring spring 28 is used to suspend the hanger bar on a clothes-drying bar, wherein the sections of the engaging projection 13 and the hanger 5 and the side face of the suspending member 2 are shown similarly to FIG. 13. The structure of the hanging member 1 and the usage and the effect of the hanger bar are the same as those of the hanger bar shown in FIG. 1, and hence, like reference numerals are used to refer to like elements in FIG. 23 and the description is omitted. As is shown in FIG. 23, in suspending the suspending member 2 on the bar 3, the bar 3 can be easily guided to the center of the clipping part 21 even when the bar 3 has a large diameter because the tip portions of the clipping pieces of the clipping part 21 are curved outward. In addition, when the bar 3 is clipped, since the split ring spring 28 applies a strong force to the clipping pieces of the clipping part 21 in the direction to make the clipping pieces closer to each other, the clipping part 21 can be strongly fixed on the bar 3 even when the bar 3 has a small or large diameter. Furthermore, even when the suspending members 2 are suspended on a bar 3 with a small diameter after being suspended on a bar with a larger diameter for a long period of time, the clipping force for clipping the bar 3 with the small diameter cannot be weakened because of the elasticity restoring force of the split ring spring 28.

In this manner, according to this invention, hangers are hung on the bottoms of recesses aligned on a hanging member, and hence, the hangers are prevented from being gathered in an end part of a bar against a wind. As a result sufficiently good airing can be retained, and the efficiency in drying garments on the hangers can be improved. In addition, since each recess for catching a hanger is provided with a projection at its bottom, the hanger can be stably caught. Moreover, the suspending members are rotatably linked with the ends of the hanging member, the shape of the hanger bar can be changed suitably for the usage and the storage. Furthermore, a hanger having a recess fittable with a projection can be used, and the shape of the hanger can be changed through its rotation so that the hanger is supported in the lateral direction or in the longitudinal direction. Therefore, a garment can be smoothly hung on or removed from the hanger.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

I claim:

1. An hanger bar, comprising:

an elongated hanging member provided with a plurality of first recesses for catching hangers, the first recesses being aligned along the length of the hanging member so as to have openings facing in an upward direction, each first recess having on the bottom thereof an upwardly directed engaging portion having an arcuate top portion which conforms substantially in cross-sectional shape to the shape of the hook portion of a garment hanger, the cross-section being taken in a plane perpendicular to the length of the hanging member; and suspending members, for supporting the hanging member, set on both ends of the hanging member aligned with the direction of the first recesses.

2. The hanger bar according to claim 1, wherein each connecting portion between the adjacent first recesses is provided with a second recess having an opening facing in a direction reverse to the direction faced by the opening of the first recess.

3. The hanger bar according to claim 2, wherein each of the suspending members is linked with the hanging member rotatably with the end of the hanging member as a center on a plane on which the first and second recesses are aligned.

4. The hanger bar according to claim 1, further comprising a hanger including a shoulder part constructed to receive and retain a hanging object, a third recess conforming in shape substantially to said top portion of the engaging portion being formed at substantially a center and lower part of the shoulder part, the engaging portion being caught in the third recess, whereby the hanger is supported by the hanger bar.

5. The hanger bar according to claim 1, each of the suspending members including:

clipping pieces opposing each other and linked with each other at one end thereof through a bent portion, each of the clipping pieces rounding out at substantially a center thereof, the other end of each of the clipping pieces being curved outward, and the clipping pieces are provided, at portions closer to the bent portion, with spring bearing pieces projected outward from outer faces of the clipping pieces, for supporting ends of a split ring spring for applying a force in a direction to make the clipping pieces closer to each other;

each of the spring bearing pieces including:

a stop portion having a face formed toward the bent portion of the suspending member for stopping movement of the split ring spring in a lengthwise direction of the clipping pieces at the tips of the split ring spring; and first and second restricting portions each having a face formed along the lengthwise direction of the clipping pieces for restricting movement of the split ring spring in a widthwise direction of the clipping pieces at both sides of the ends of the split ring spring, and the split ring spring is supportable to be positioned along the bent portion with the ends thereof inserted into the spring bearing pieces.

6. The hanger bar according to claim 3, each of the suspending members including:

clipping pieces opposing each other and linked with each other at one end thereof through a bent portion, each of the clipping pieces rounding out at substantially a center thereof, the other end of each of the clipping pieces being curved outward, and the clipping pieces are provided, at portions closer to the bent portion, with spring bearing pieces projected outward from outer faces of the clipping pieces, for supporting ends of a split ring spring for applying a force in a direction to make the clipping pieces closer to each other;

each of the spring bearing pieces including:

a stop portion having a face formed toward the bent portion of the suspending member for stopping movement of the split ring spring in a lengthwise direction of the clipping pieces at the tips of the split ring spring; and first and second restricting portions each having a face formed along the lengthwise direction of the clipping pieces of restricting movement of the split ring spring in a widthwise direction of the clipping pieces at both sides of the ends of the split ring spring, and the split ring spring is supportable to be positioned along the bent portion with the ends thereof inserted into the spring bearing pieces.

* * * * *